US008449388B2

(12) United States Patent
Nicely et al.

(10) Patent No.: US 8,449,388 B2
(45) **Date of Patent: *May 28, 2013**

(54) GAMING SYSTEM AND METHOD HAVING PROGRESSIVE AWARDS WITH METER INCREASE EVENTS

(75) Inventors: Mark C. Nicely, Daly City, CA (US); Paul D Miltenberger, San Francisco, CA (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/335,420

(22) Filed: Dec. 22, 2011

(65) Prior Publication Data

US 2012/0094749 A1 Apr. 19, 2012

Related U.S. Application Data

(63) Continuation of application No. 11/862,843, filed on Sep. 27, 2007, now Pat. No. 8,096,874.

(51) Int. Cl.
*A63F 9/24* (2006.01)

(52) U.S. Cl.
USPC ..... 463/27

(58) Field of Classification Search
USPC ..... 463/27
See application file for complete search history.

(56) References Cited

U.S. PATENT DOCUMENTS 5,116,055 A 5/1992 Tracy
5,158,293 A 10/1992 Mullins
5,275,400 A 1/1994 Weingardt
5,280,909 A 1/1994 Tracy
5,324,035 A 6/1994 Morris et al.
5,326,104 A 7/1994 Pease et al.
5,344,144 A 9/1994 Canon
5,423,539 A 6/1995 Nagao
5,476,259 A 12/1995 Weingardt
5,560,603 A 10/1996 Seelig et al.
5,645,486 A 7/1997 Nagao et al.

(Continued)

FOREIGN PATENT DOCUMENTS

AU 711501 10/1999
DE 3915855 11/1990

(Continued)

OTHER PUBLICATIONS

Third Party Submission in Published Application Under 37 C.F.R. § 1.99 filed for U.S. Appl. No. 13/335,420, dated Jun. 18, 2012 (2 pages).

(Continued)

*Primary Examiner* — Corbett B Coburn
(74) *Attorney, Agent, or Firm* — Neal, Gerber & Eisenberg LLP

(57) ABSTRACT

A gaming system including a central server linked to a plurality of gaming machines. The gaming system includes at least one and preferably a plurality of progressive awards which are each associated with a supplemental fund or pool. If the gaming system determines that the progressive award is not growing at a designated incremental rate (due to a lack of wagers placed on gaming devices associated with the progressive award), the gaming system utilizes part or all of the amount in the supplemental fund to make up for this lack of wager based growth. Such a configuration provides that even if players are not actively playing gaming devices associated with the progressive award, the progressive award will still increment at a designated rate to at least a desirable value.

24 Claims, 9 Drawing Sheets

U.S. PATENT DOCUMENTS

| | | | |
|---|---|---|---|
| 5,655,961 | A | 8/1997 | Acres et al. |
| 5,741,183 | A | 4/1998 | Acres et al. |
| 5,752,882 | A | 5/1998 | Acres et al. |
| 5,766,076 | A | 6/1998 | Pease et al. |
| 5,769,716 | A | 6/1998 | Saffari et al. |
| RE35,864 | E | 7/1998 | Weingardt |
| 5,779,549 | A | 7/1998 | Walker et al. |
| 5,836,817 | A | 11/1998 | Acres et al. |
| 5,851,148 | A | 12/1998 | Brune et al. |
| 5,851,149 | A | 12/1998 | Xidos et al. |
| 5,855,515 | A | 1/1999 | Pease et al. |
| 5,876,284 | A | 3/1999 | Acres et al. |
| 5,885,158 | A | 3/1999 | Torango et al. |
| 5,947,820 | A | 9/1999 | Morro et al. |
| 5,997,400 | A | 12/1999 | Seelig et al. |
| 6,001,016 | A | 12/1999 | Walker et al. |
| 6,012,982 | A | 1/2000 | Piechowiak et al. |
| 6,012,983 | A | 1/2000 | Walker et al. |
| 6,089,980 | A | 7/2000 | Gauselmann |
| 6,099,408 | A | 8/2000 | Schneier et al. |
| 6,110,041 | A | 8/2000 | Walker et al. |
| 6,135,884 | A | 10/2000 | Hedrick et al. |
| 6,142,872 | A | 11/2000 | Walker et al. |
| 6,159,098 | A | 12/2000 | Slomiany et al. |
| 6,162,121 | A | 12/2000 | Morro et al. |
| 6,162,122 | A | 12/2000 | Acres et al. |
| 6,168,520 | B1 | 1/2001 | Baerlocher et al. |
| 6,186,894 | B1 | 2/2001 | Mayeroff |
| 6,190,255 | B1 | 2/2001 | Thomas et al. |
| 6,203,010 | B1 | 3/2001 | Jorasch et al. |
| 6,203,430 | B1 | 3/2001 | Walker et al. |
| 6,224,483 | B1 | 5/2001 | Mayeroff |
| 6,231,445 | B1 | 5/2001 | Acres |
| 6,241,608 | B1 | 6/2001 | Torango |
| 6,244,958 | B1 | 6/2001 | Acres |
| 6,254,483 | B1 | 7/2001 | Acres |
| 6,257,981 | B1 | 7/2001 | Acres et al. |
| RE37,414 | E | 10/2001 | Harlick |
| 6,312,333 | B1 | 11/2001 | Acres |
| 6,319,125 | B1 | 11/2001 | Acres |
| 6,364,768 | B1 | 4/2002 | Acres et al. |
| 6,371,852 | B1 | 4/2002 | Acres |
| 6,375,567 | B1 | 4/2002 | Acres |
| 6,375,569 | B1 | 4/2002 | Acres |
| 6,431,983 | B2 | 8/2002 | Acres |
| 6,435,968 | B1 | 8/2002 | Torango |
| RE37,885 | E | 10/2002 | Acres et al. |
| 6,565,434 | B1 | 5/2003 | Acres |
| 6,589,115 | B2 | 7/2003 | Walker et al. |
| 6,599,193 | B2 | 7/2003 | Baerlocher et al. |
| 6,607,438 | B2 | 8/2003 | Baerlocher et al. |
| 6,626,758 | B1 | 9/2003 | Parham et al. |
| 6,648,757 | B1 | 11/2003 | Slomiany et al. |
| 6,656,052 | B2 | 12/2003 | Abramopoulos et al. |
| 6,712,697 | B2 | 3/2004 | Acres |
| 6,800,030 | B2 | 10/2004 | Acres |
| 6,832,958 | B2 | 12/2004 | Acres et al. |
| 6,869,361 | B2 | 3/2005 | Sharpless et al. |
| 6,887,154 | B1 | 5/2005 | Luciano, Jr. et al. |
| 6,899,625 | B2 | 5/2005 | Luciano, Jr. et al. |
| 6,908,387 | B2 | 6/2005 | Hedrick et al. |
| 6,910,964 | B2 | 6/2005 | Acres |
| RE38,812 | E | 10/2005 | Acres et al. |
| 7,056,215 | B1 | 6/2006 | Olive |
| 7,273,415 | B2 | 9/2007 | Cregan et al. |
| 7,297,059 | B2 | 11/2007 | Vancura et al. |
| 7,651,394 | B2 | 1/2010 | Johnson |
| 7,931,532 | B2 | 4/2011 | Johnson |
| 2002/0071557 | A1 | 6/2002 | Nguyen |
| 2002/0116615 | A1 | 8/2002 | Nguyen et al. |
| 2002/0138594 | A1 | 9/2002 | Rowe |
| 2002/0151354 | A1 | 10/2002 | Boesen et al. |
| 2002/0187834 | A1 | 12/2002 | Rowe et al. |
| 2003/0027625 | A1 | 2/2003 | Rowe |
| 2003/0030211 | A1 | 2/2003 | Brown |
| 2003/0060266 | A1 | 3/2003 | Baerlocher |
| 2003/0060269 | A1 | 3/2003 | Paulsen et al. |
| 2003/0060279 | A1 | 3/2003 | Torango |
| 2003/0216166 | A1 | 11/2003 | Baerlocher et al. |
| 2003/0222402 | A1 | 12/2003 | Olive |
| 2004/0009811 | A1 | 1/2004 | Torango |
| 2004/0048644 | A1 | 3/2004 | Gerrard et al. |
| 2005/0119047 | A1 | 6/2005 | Olive |
| 2005/0143168 | A1 | 6/2005 | Torango |
| 2005/0176488 | A1 | 8/2005 | Olive |
| 2005/0209004 | A1 | 9/2005 | Torango |
| 2006/0030403 | A1 | 2/2006 | Lafky et al. |
| 2006/0035694 | A1 | 2/2006 | Fuller |
| 2006/0040732 | A1 | 2/2006 | Baerlocher et al. |
| 2006/0073887 | A1 | 4/2006 | Nguyen et al. |
| 2006/0142079 | A1 | 6/2006 | Ikehara et al. |
| 2006/0183535 | A1 | 8/2006 | Marks et al. |
| 2006/0183538 | A1 | 8/2006 | Michaelson et al. |
| 2006/0236116 | A1 | 10/2006 | Patel |
| 2006/0287077 | A1 | 12/2006 | Grav et al. |
| 2007/0054733 | A1 | 3/2007 | Baerlocher |
| 2007/0060271 | A1 | 3/2007 | Cregan et al. |
| 2007/0060320 | A1 | 3/2007 | Kelly et al. |
| 2007/0060321 | A1 | 3/2007 | Vasquez et al. |
| 2007/0105620 | A1 | 5/2007 | Cuddy et al. |
| 2007/0184887 | A1 | 8/2007 | Cannon |
| 2007/0202943 | A1 | 8/2007 | Thomas |
| 2007/0213114 | A1 | 9/2007 | Caspers et al. |
| 2007/0218982 | A1 | 9/2007 | Baerlocher |
| 2007/0259709 | A1 | 11/2007 | Kelly et al. |
| 2007/0298875 | A1 | 12/2007 | Baerlocher et al. |
| 2008/0032782 | A1 | 2/2008 | Boesen et al. |

FOREIGN PATENT DOCUMENTS

| | | |
|---|---|---|
| GB | 2 137 392 A | 10/1984 |
| WO | WO 00 12186 | 3/2000 |
| WO | WO 00 32286 | 6/2000 |
| WO | WO 02 07836 | 1/2002 |
| WO | WO 2005 083599 | 9/2005 |
| WO | WO 2005 099425 | 10/2005 |

OTHER PUBLICATIONS

Excerpt from Local Area Electronic Gaming Machine Communications Protocol, QCOM Version 1.5, by Queensland Treasury Office of Gaming Regulation printed Feb. 26, 1998.

Fast Buck Systems Manual, written by International Game Technology, available to Mirage shift supervisors at least as early as May 30, 1990.

Integrated Real Time On-Line Slot System—SDI, written by GRIPS Electronic GmbH, printed from website reported as archived on Feb. 20, 1997 (available at http://web.archive.org/web/19970220165559/www.grips.com/sdi.htm).

PEM—Precision Electronic Meter, written by GRIPS Electronic GmbH, printed from website reported as archived on Feb. 20, 1997 (available at http://web.archive.org/web/19970220165753/www.grips.com/pem.htm).

Progressive Jackpot System article, printed from casinomagazine.com.managearticle.asp@c_290&a=518, on Jun. 21, 2004.

ProLINK Progressive Controller User/Reference Manual, written by Casino Data Systems, published in Apr. 1997.

Slot Machines a Pictorial History of the First 100 Years (pp. 216, 242 to 243), 5th edition, written by Marshall Fey, published in 1983-1997.

Wide Area Progressive Link System, written by GRIPS Electronic GmbH, printed from website reported as archived on Feb. 20, 1997 (available at http://web.archive.org/web/19970220165457/www.grips.com/wap.htm).

FIG.5

| | Sample Period #1 | Sample Period #2 | Sample Period #3 | Sample Period #4 |
|---|---|---|---|---|
| Wager based Incremental Rate (progressive award growth/minute) | $0.30 | $0.45 | $0.75 | $1.15 |
| Supplemental Incremental Rate (progressive award growth/minute) | $0.70 | $0.55 | $0.25 | $0.00 |
| Total Incremental Rate (progressive award growth/minute) | $1.00 | $1.00 | $1.00 | $1.15 |
| Value of Progressive Award | $1003.45 | $1156.56 | $1367.98 | $1489.13 |

FIG. 7A 16,18

Value of Progressive Award: $1,005,651.19

This Progressive Award Needs a Pick-Me-Up.

Let's Give this Progressive Award a Boost.

FIG. 7B 16,18

Casino X has added $1000 to the Progressive Award

New Value of Progressive Award: $1,006,651.19

Good Luck Players.

GAMING SYSTEM AND METHOD HAVING PROGRESSIVE AWARDS WITH METER INCREASE EVENTS

PRIORITY CLAIM

This application is a continuation of, and claims the benefit of and priority to, U.S. patent application No. 11/862,843, filed on Sep. 27, 2007, which issued as U.S. Pat. No. 8,096,874 on Jan. 17, 2012, the entire contents of which is incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one penny, nickel, dime, quarter or dollar) up to a maximum number of credits, such as five credits. This wager may be made by the player a single time or multiple times in a single play of the primary game. For instance, a slot gaming device may have one or more paylines and the slot gaming device may enable the player to make a wager on each payline in a single play of the primary game. Thus, it is known that a gaming machine, such as a slot gaming device, may enable players to make wagers of substantially different amounts on each play of the primary or base game ranging, for example, from 1 credit up to 125 credits (e.g., 5 credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot gaming machine may trigger the secondary bonus game. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

Progressive awards associated with gaming machines are also known. In one form, a progressive award is an award amount which includes an initial amount funded by a casino and an additional amount funded through a portion of each wager made on the progressive gaming machines. For example, 0.1% of each wager placed on the primary games of the gaming machines associated with the progressive award may be allocated to the progressive award or progressive award fund or pool. The progressive award grows in value as more players play the gaming machines and more portions of these players' wagers are allocated to the progressive award. When a player obtains a winning symbol or symbol combination associated with the progressive award, the accumulated progressive award is provided to the player. After the progressive award is provided to the player, the amount of the next progressive award is reset to the initial value and a portion of each subsequent wager on a gaming machine associated with a progressive award is allocated to the next progressive award.

In another form, a progressive award includes several special purpose funds, wherein a portion of each wager made on the progressive gaming machines is allocated to one or more of these different funds of the progressive award. For example, a progressive award includes a displayed meter (which is the current displayed value of the progressive award) and a reset fund (to support future resets of the displayed meter). A progressive award may also include a lag fund (which aggregates all wagers made during one period of time, such as 10 to 30 seconds, to increase the displayed meter for the next period of time), an escrow fund (as described below), a reserve fund, an operations expense fund or any combination thereof.

A progressive award may be associated with or otherwise dedicated to a single or stand-alone gaming machine. Alternatively, a progressive award may be associated with or otherwise dedicated to multiple gaming machines which each contribute a portion of wagers placed at such gaming machines to the progressive award. The multiple gaming machines may be in the same bank of gaming machines, in the same casino or gaming establishment (usually through a local area network ("LAN")) or in two or more different casinos or gaming establishments (usually through a wide area network ("WAN")). Such progressive awards played for by one or more gaming devices in the same gaming establishment sometimes called local area progressives ("LAP") and such progressive awards played for by a plurality of gaming devices at a plurality of different gaming establishments are sometimes called wide area progressives ("WAP").

Moreover, a gaming machine or bank of gaming machines may be simultaneously associated with a plurality of progressive awards. In these multi-level progressive ("MLP") configurations, a plurality of progressive awards start at different award or value levels, such as $10, $100, $1000 and $10,000 and each individually increment or increase until provided to a player. Upon a suitable triggering event at one of more of the gaming devices associated with the MLP, one or more of the progressive awards which form the MLP are provided to one or more of the players at such gaming devices.

One problem that exists with such known progressive award gaming systems is that if the progressive award is initially implemented in association with a relatively small number of gaming devices, the progressive award initially increments at a relatively slow growth or incremental rate. That is, without a relatively large number of players playing at gaming devices associated with the progressive award, the progressive award increments at an unattractive rate and takes a substantial period of time to climb to a high value. This situation may cause certain players not to play at the gaming devices associated with the progressive award because they do not find the progressive award desirable or worth the playing. Such players avoiding the gaming devices associated with the progressive award further slows the growth rate of the progressive award which in turn causes it to take a longer period of time for the progressive award to climb to a high value.

Another similar problem with known progressive award gaming systems is that after a progressive award is provided to one or more players, the next progressive award often takes a substantial period of time to climb back to a relatively high value. This discourages certain players who do not wish to play for a base or reset level progressive award. Such discouragement, often known as jackpot fatigue, can lead to players walking away from the gaming devices of the progressive award gaming system because they no longer find the progressive award desirable or worth the cost of continuing to play.

Another problem with known progressive award gaming systems is that in gaming environments that operate twenty-four hours a day, the level of play at off-peak hours can be significantly lower than the level of play at peak hours. In such an environment, the growth of a progressive award can be extremely slow or even non-existent during the off-peak hours when there is little or no play. Similarly, the progressive award growth rate during peak hours can be well above what most players would consider to be a suitable rate. For these reasons, in some progressive systems, a progressive award escrow is established. In such a system, a portion of the money that would go to the progressive award during peak-hours is instead diverted to fund a temporary escrow fund which is not displayed to players, but is subsequently used to increase the progressive award growth rate during off-peak hours.

For example, peak hours for a gaming establishment are 4:00 pm to 12:00 am and a given progressive system gets five times the amount of play during peak hours than during other hours of the day. Specifically, during peak hours, the progressive award grows, on average, 5 cents every second whereas during off-peak hours, the progressive award grows, on average, 1 cent every second. In this example, a growth rate lower than 1.5 cents every second may be considered too slow to be exciting to certain players. In such a situation, an award escrow is known to be used to smooth the progressive award growth over the day to use at least part of peak hour wager based contributions to the progressive award to increase off-peak hour progressive award growth. That is, an amount which is based on player's wagers at the gaming devices in the gaming system is not added directly to the progressive award but rather is diverted to a separate award escrow where it is used to supplement the off-peak hours progressive award growth rate. For example, if half of the potential peak-hour wager based progressive award growth is diverted to a temporary escrow account, then the peak hour progressive award would grow, on average, 2.5 cents every second and would fund the escrow 2.5 cents×60 seconds/minute×60 minutes/hour×8 peak hours=$720.00. This escrow account is used to boost progressive award growth during the off-peak hours, thus the progressive award during the off-peak hours would grow by $720.00. In this example, 16 off-peak hours×60 seconds/minute×60 minutes/hour is 57,600 seconds, so $720.00/57,600 seconds means 1.25 cents every second of additional progressive award growth during off-peak hours. Combined with the usual 1 cent per second average wager based growth during off-peak hours, such additional progressive award growth would yield an effect off-peak hours progressive award growth rate of 1 cent per second+1.25 cents per second=2.25 cents per second. It should be appreciated that in many gaming jurisdictions, the progressive award growth that has been diverted to escrow is considered to be part of the actual progressive award, even if this escrowed value is not displayed to the player. For example, if a given player wins a given progressive award with the displayed value of $123,456.78, but the escrow fund at the time is worth $310.00, the actual award provided to the player is $123,766.78 (or $123,456.78+$310.00).

Accordingly, there is a continuing need to provide new and different gaming machines and gaming systems which provide one or more progressive award to one or more players.

SUMMARY

The gaming system disclosed herein includes at least one and preferably a plurality of progressive awards or progressive incremented values adapted to be provided to a player. In one embodiment, upon an occurrence of each progressive award increase event, the gaming system adds a value or amount to the progressive award independent of any value or amount directly attributed to the wagers placed at the gaming devices associated with the progressive award or the timing these wagers are placed. In one embodiment, at least one progressive award is associated with a supplemental fund or pool which the gaming system utilizes to ensure that the progressive award increments or grows at least a designated rate or pace. In this embodiment, if the progressive award is not growing at a designated growth or incremental rate due to a lack of wagers placed on gaming devices associated with the progressive award (i.e., the occurrence of a progressive award increase event), the gaming system utilizes part or all of the amount in the supplemental fund to make up for this lack of wager based growth. In another embodiment, at least one progressive award is associated with a guaranteed growth rate independent of any supplemental fund or pool. In this embodiment, if the progressive award is not growing at a designated growth or incremental rate due to a lack of wagers placed on gaming devices associated with the progressive award (i.e., the occurrence of a progressive award increase event), the gaming system makes up for this lack of wager based growth. Such configurations provide that even if players are not actively playing gaming devices associated with the progressive award, the progressive award will still increment at a designated rate for a period of time or until the progressive award increments to at least a desirable value. This incrementing of the progressive award can cause more players to play at gaming devices associated with the progressive award which in turn provides that the progressive award will increment at a greater rate to a desirable higher value.

In one embodiment, the gaming system disclosed herein includes a central server, central controller or remote host in communication with or linked to a plurality of gaming machines or gaming devices. In another embodiment, the gaming system includes a plurality of linked gaming machines, wherein one of the gaming machines functions as the central server, central controller or remote host. In another embodiment, the gaming system disclosed herein is implemented over a data network, such as an internet or intranet. In this embodiment, utilizing at least one internet browser, the operation of the gaming device can be viewed at the gaming device or at a location remote from a gaming establishment. In another embodiment, the gaming system disclosed herein includes a single stand-alone gaming device which is associated with one or more progressive awards. In this embodiment, at least one of the progressive awards is maintained by, associated with and dedicated to the stand-alone gaming device.

In one embodiment, the central server maintains at least one and preferably a plurality of progressive awards for the gaming devices in the gaming system. In one embodiment, at least one and preferably a plurality of progressive awards are each associated with a value or amount in a designated fund or pool. The designated fund or pool at least includes a reset value or initial value for the progressive award and a supplemental fund or pool for the progressive award. The central server utilizes the reset or initial value to fund the progressive award upon the initial implementation of the progressive award or after the progressive award is provided to a player. The central server utilizes the supplemental fund or pool to periodically add or inject value to the progressive award if the progressive award is not incrementing or growing at or above a designated rate. In other words, the central server utilizes part, but not all, of the designated fund to seed or initially fund the progressive award and if necessary, periodically adds at least part of the designated fund to the progressive award such that the progressive award at least appears to grow or increment based on gaming activity at the gaming devices associated with the progressive award. For example, if the designated pool for the progressive award includes $1,500,000, the central server utilizes $1,000,000 to initially fund the progressive award (i.e., upon the initial implementation of the progressive award) and if necessary, utilizes the remaining $500,000 to add or inject value to the progressive award based on the occurrences of one or more progressive award increase events.

In one such embodiment, a progressive award increase event occurs if the central server determines that the progressive award is incrementing at a rate below a designated growth rate. In this embodiment, at preset intervals based on a suitable sampling rate, the central server determines if the progressive award increase event occurs by comparing the actual progressive award growth rate to the designated growth rate. If the progressive award increase event occurs, the central server supplements the growth of the progressive award with part or all of any value of the supplemental fund or pool. That is, the central server enables a gaming system operator to specify a target or designated progressive award growth or incremental rate. If player volume is too low to support this target progressive award growth rate, a progressive award increase event occurs and the central server adds or injects value into the progressive award from the supplemental fund or pool to make up for this shortfall in the progressive award growth rate. For example, if a designated incremental growth rate of a progressive award is, on average, $0.05 per second over a designated period of time and the progressive award is currently incrementing at an average of $0.03 per second over a sampled period of time (due to the number of wagers currently placed on the gaming devices associated with the progressive award), the central server utilizes any value or amount in the supplemental fund or pool to add a value to the progressive award such that the progressive award is continually incrementing or growing at least at the designated incremental growth rate of an average of $0.05 per second over the designated period of time.

It should be appreciated that the progressive award increase event may be any suitable event or non-occurrence of an event which may be tracked by the gaming system. In different embodiments, an occurrence of a progressive award increase event may include, but not be limited to, a determination that the progressive award is incrementing at a rate below a designated growth rate, a determination that no contributions have been made to the progressive award during a given period of time, an elapsed period of time, a determination based on a frequency of an event over an elapsed period of time, a determination based on a plurality of events occurring over an elapsed period of time, a randomly determined event, a predetermined event, a determination based on a generated symbol or symbol combination, a determination based on the status of one or more players (such as determined through a player tracking system), a determination based on a gaming system operator and any combination thereof. It should be further appreciated that any suitable manner of adding value to the progressive award (in addition to or substituting for any value added to the progressive award based on wagers placed by players at the gaming devices associated with the progressive award) may be implemented in association with the gaming system disclosed herein.

In one embodiment, a gaming system operator specifies an amount of progressive award growth that is to occur within a specified period of time. Such specification may be a one-time specification, such as add $10,000.00 over the next 48 hours or such specification may be ongoing, such as add 1 cent per second indefinitely until specified otherwise. In one embodiment, the gaming system operator specifies a minimum progressive award growth rate, such as a command that the progressive award grows at least 2 cents per second. In another embodiment, the gaming system operator may specify minimum progressive award growth rates relative to specific time of day and/or day of week. In another embodiment, the gaming system operator specifies a maximum amount of progressive growth to occur over a specific period of time. For example, a gaming system operator can specify that there be a minimum of 2 cents per second progressive award growth not to exceed $750.00 worth of contribution per a given 24 hour period.

In another embodiment, a plurality of progressive award increase events occur at different periods of time to ensure that the growth of the progressive award is substantially aligned with a theoretical growth of a progressive award based on one or more growth criteria. In one such embodiment, the central server enables a gaming system operator to specify different progressive award growth or incremental rates for different time periods. As each progressive award increase event occurs, the central server utilizes part or all of any value of the supplemental fund or pool to add or inject value into the progressive award such that the progressive award better matches the expected appearance of the progressive award incrementing faster during peak periods of gaming and incrementing slower during off-peak periods of gaming.

In one embodiment, if a progressive award triggering event occurs in any suitable manner and the progressive award is provided to one or more players while the amount or value in any supplemental fund or pool is greater than zero (i.e., before the supplemental fund is fully spent), the remaining amount in the supplemental fund is provided to the player. In another embodiment, if a progressive award triggering event occurs and the progressive award is provided to one or more players while the amount or value in any supplemental fund or pool is greater than zero, the remaining amount in the supplemental fund is utilized as part of the next supplemental fund for the next progressive award.

In one embodiment, the above-described independent funding may also be provided in addition to an escrow funding system. Specifically, if peak hour player contributions exceed an upper specified rate, some of these funds can be diverted into an off-peak hour escrow. However, if the progressive award growth rate, including any growth available from an escrow fund, falls below a lower specified rate, then the independent funding source is used to assure a minimum level of progressive award growth.

Accordingly, the gaming system disclosed herein counteracts jackpot fatigue and provides that one or more progressive awards will increment in value independent of any gaming activity at the gaming devices associated with the progressive award. Such a configuration of subsidizing the growth of the progressive award will cause more players to play at gaming devices associated with the progressive award which in turn provides that the progressive award will increment at a greater rate to a desirable higher value.

Additional features and advantages are described in, and will be apparent from, the following Detailed Description and the figures.

BRIEF DESCRIPTION OF THE FIGURES

FIG. 5 is a chart illustrating sample periods of growth for a progressive award of one embodiment of the gaming system disclosed herein.

FIGS. 7A and 7B are top plan views of a display device associated with one embodiment of the gaming system disclosed herein illustrating information relating to the gaming system adding a value from a supplemental pool to a progressive award.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
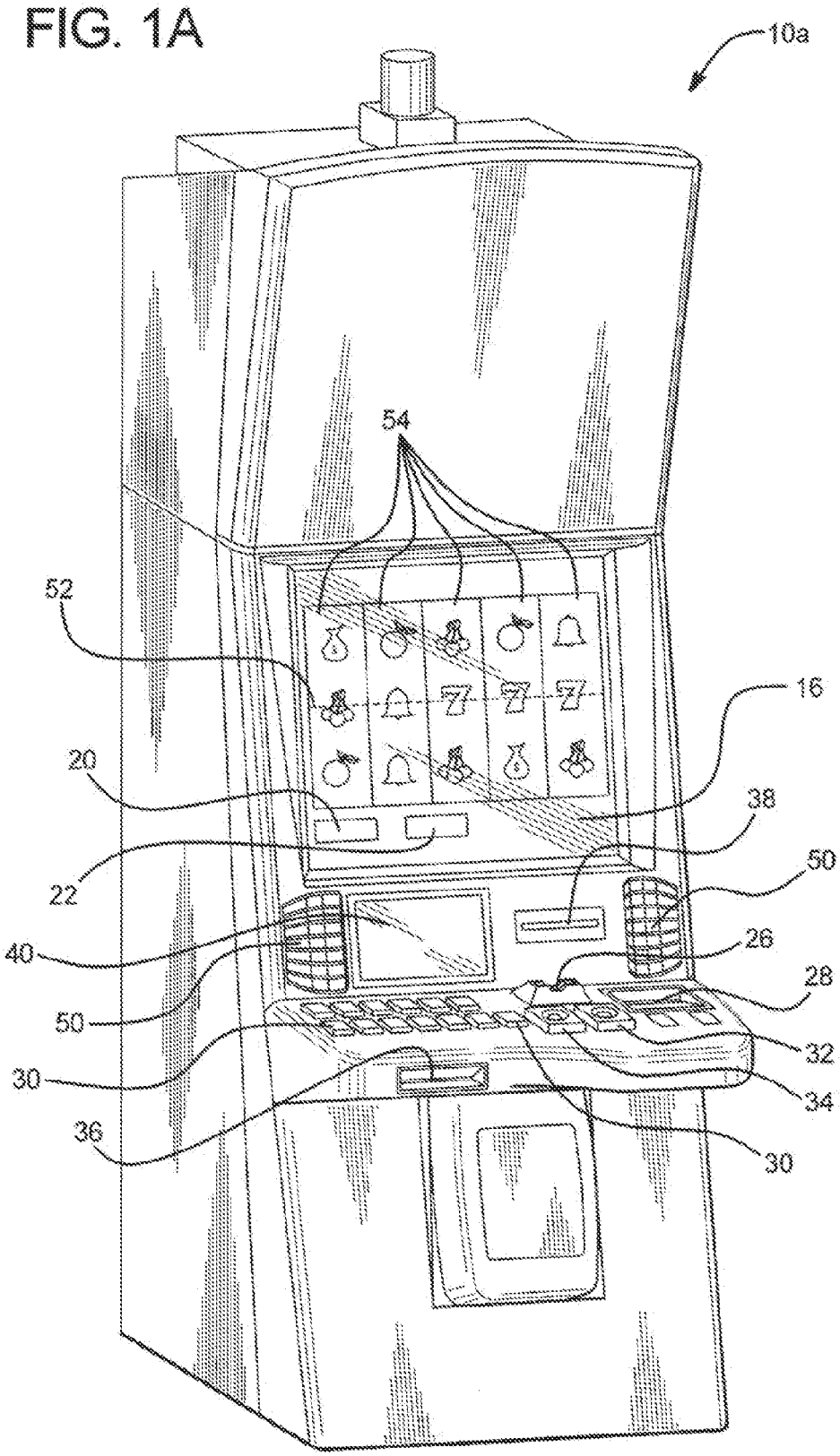
FIGS. 1A and 1B are front perspective views of alternative embodiments of gaming devices disclosed herein.
Figure 1B:
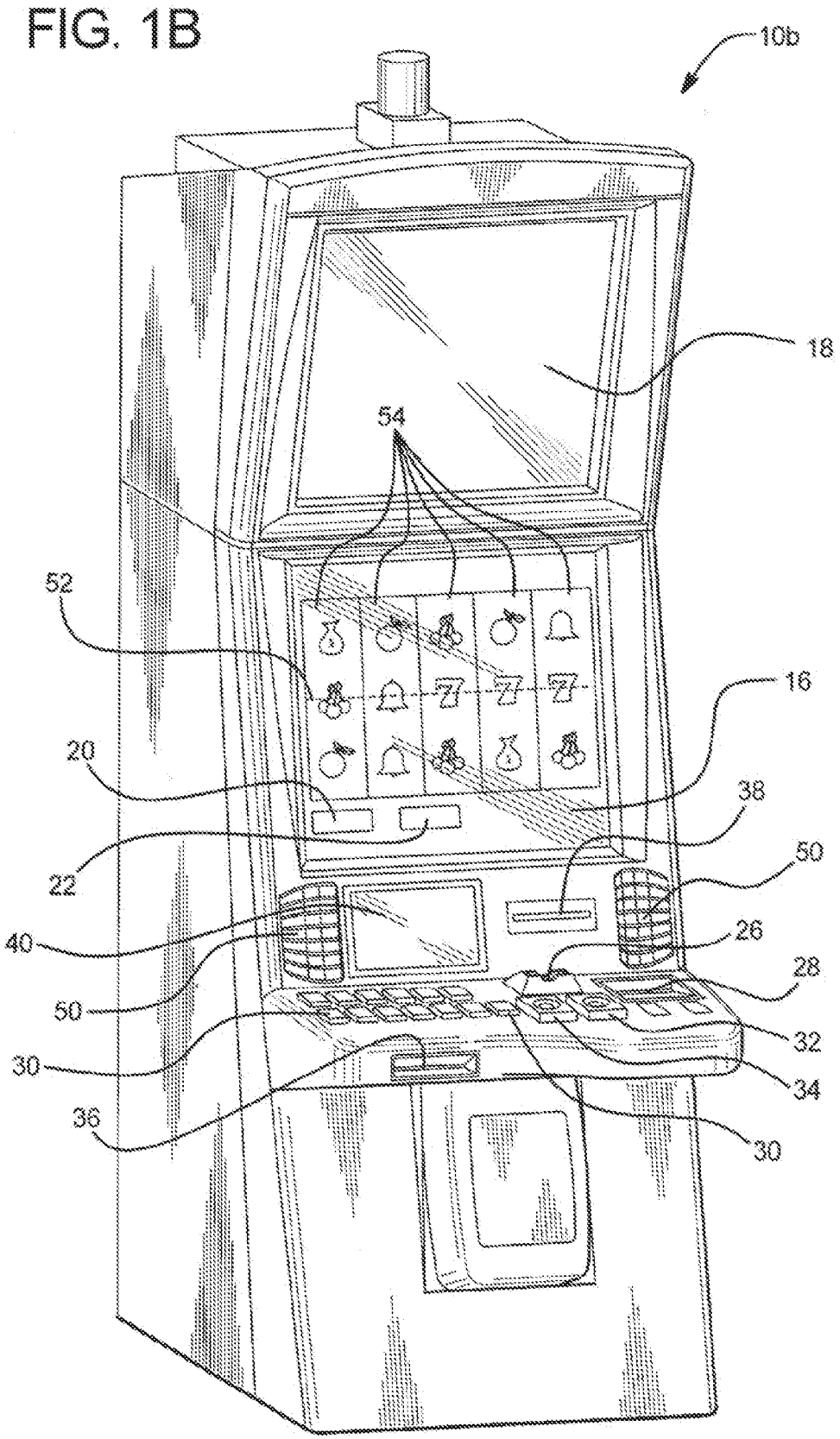

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
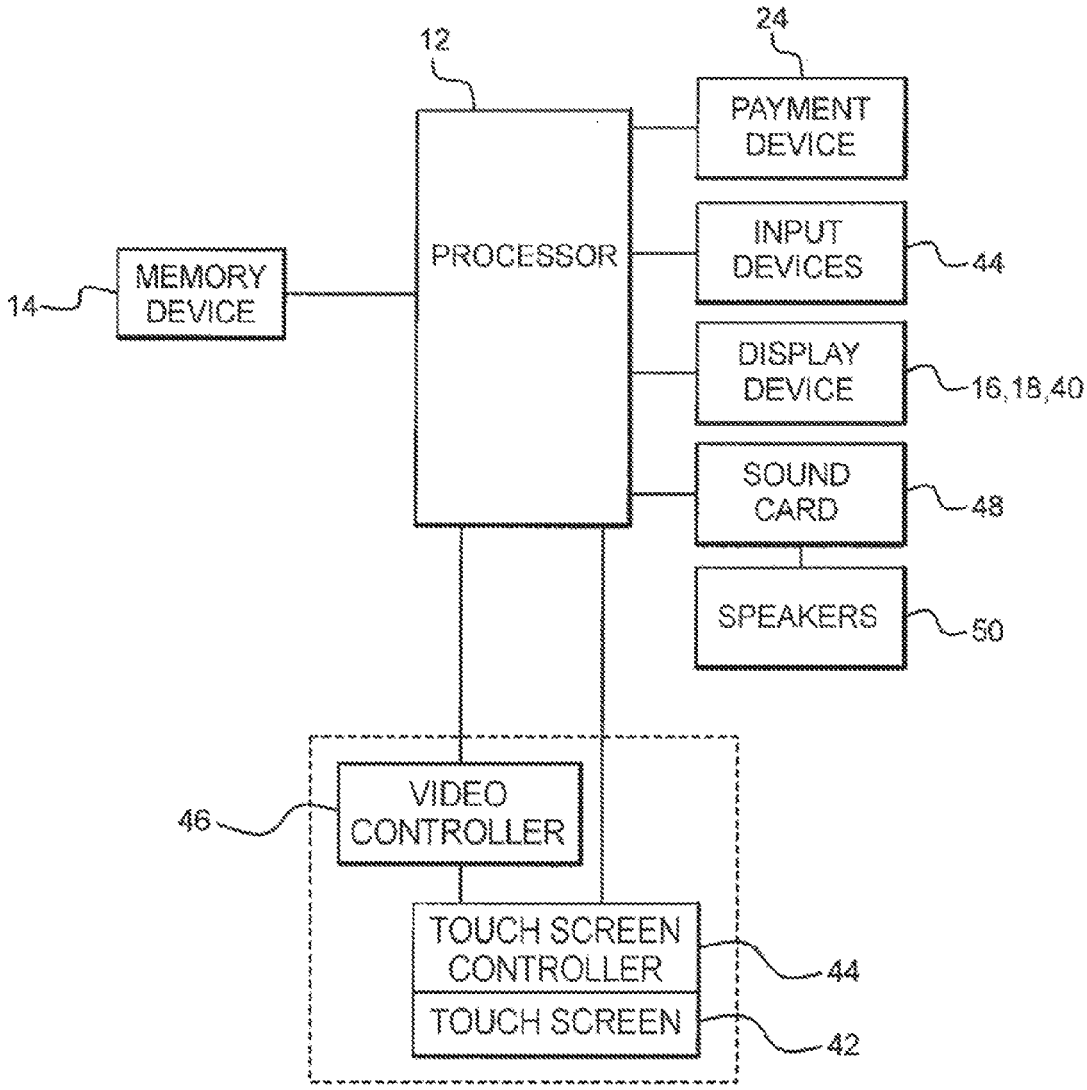
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
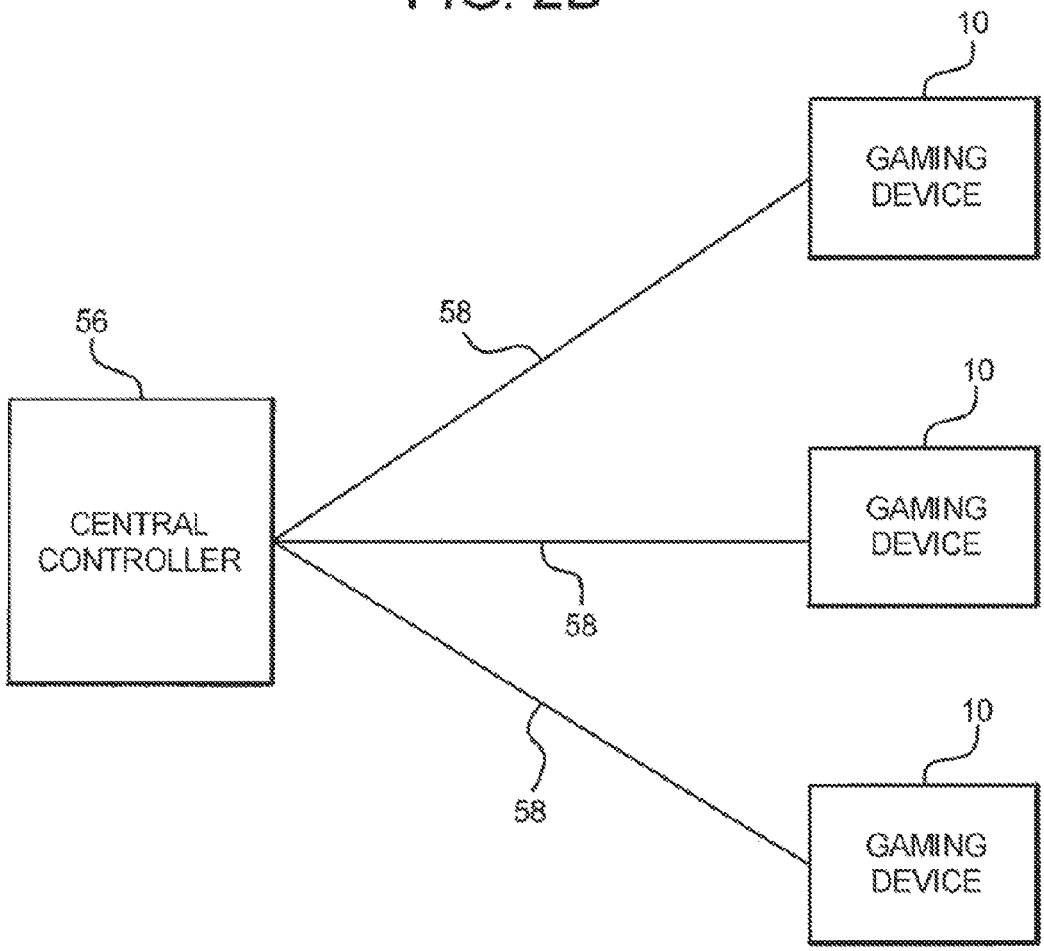
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the gaming system disclosed herein is implemented via a data network, such as an internet or intranet. In one such embodiment, the operation of a gaming device can be viewed at the gaming device with at least one internet browser. In another such embodiment, the operation of a gaming device can be viewed at a location remote from the gaming device or gaming establishment utilizing at least one internet browser. In these embodiments, operation of the gaming device may be accomplished with only a connection to the central server or controller (i.e., an internet/intranet server) through a conventional phone or other data transmission line, digital subscriber line (DSL), T-1 line, coaxial cable, fiber optic cable, or other suitable connection. Accordingly, players may access an internet game page from any location where an internet connection and computer, or other internet facilitator is available. It should be appreciated that the expansion in the number of computers and number and speed of internet connections in recent years increases opportunities for players to play from an ever-increasing number of remote sites. It should be further appreciated that enhanced bandwidth of digital wireless communications may render such technology suitable for some or all communications, particularly if such communications are encrypted. Higher data transmission speeds may be useful for enhancing the sophistication and response of the display and interaction with the player.

In one embodiment, the central server (i.e., an internet/intranet server) maintains at least one dedicated gaming site which is associated with one or more progressive awards and one or more supplemental funds as disclosed herein. In operation, a player logs onto the dedicated gaming site and the central server enables the player to wager on and participate in one or more online games at this gaming site. In this embodiment, upon the occurrence of any progressive award increase event, the central server adds a value or amount (from the maintained supplemental fund) to one or more of the progressive awards associated with the dedicated gaming site.

In one embodiment, to regulate and monitor the play of games over the internet, player's identifications are verified through credit card authentication. Through this authentication, the gaming system verifies the player, the player's age, the player's location and any other suitable information associated with the player. In one such embodiment, the gaming system utilizes the verified location information to monitor and ensure that the player in a certain location follows any applicable gaming regulations associated with that location. In another such embodiment, the gaming system utilizes the verified location information to set up different progressive awards for different regions. In this embodiment, different progressive awards are allotted per region.

In another embodiment including game play over the internet, the gaming system stores information about one or more players. In this embodiment, after a player has enrolled or identified themselves with the gaming system (via the dedicated gaming site), the gaming system stores their information, such as credit card information, preferred options, player number, name, or any other information in a database. In one such embodiment, the gaming system enables the player to set and store one or more gaming options, such as jackpot betting, side wagering, and preferred games, associated with the dedicated gaming site.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Progressive Awards

In one embodiment, a plurality of gaming devices at one or more gaming sites are networked to the central server in a progressive configuration, wherein a portion of each wager placed is allocated to one or more progressive awards or progressive incremented values. In another embodiment, a single or stand-alone gaming machine in the gaming system is associated with or otherwise dedicated to one or more progressive awards. In this embodiment, a portion of each wager placed at the stand-alone gaming device is allocated to the progressive awards or progressive incremented values dedicated to the gaming device. In another embodiment, as described above, one or more internet accessible dedicated gaming sites are associated with one or more progressive awards wherein a portion of each wager placed on designated online games is allocated to one or more progressive awards or progressive incremented values.

In one embodiment, one or more of the progressive awards start at different levels such as $10, $100, $1000 and $10,000 and increment or increase until provided to a player. In one embodiment, the progressive awards are associated with the system gaming machines which each contribute portions of the progressive awards. In one such embodiment, different progressive awards are associated with different numbers of gaming devices. For example, a progressive award valued at $10,000 may be associated with ten gaming devices while another progressive award valued at $500,000 may be associated with one-hundred gaming devices. In one embodiment, the multiple gaming machines may be in the same bank of machines, in the same casino or gaming establishment (such as through LAN), or in two or more different casinos or gaming establishments (such as through a WAN). In another embodiment, each individual gaming machine maintains one or more progressive awards wherein a portion of the wagers placed at that respective gaming machine is allocated to one or more progressive awards maintained by such individual gaming machine. In another embodiment, each individual gaming machine maintains one or more progressive awards and the central server simultaneously or substantially simultaneously maintains one or more progressive awards. In one such embodiment, the lower valued, more frequently triggered progressive awards are maintained by the individual gaming machines and the higher valued, less frequently triggered progressive awards are maintained by the central server. In one embodiment, a portion of each wager placed at a designated gaming device is allocated to one or more progressive awards associated with that designated gaming device. In another embodiment, a portion designated wagers placed at a designated gaming device, such as a portion of each maximum wager placed or a portion of each side wager placed, is allocated to one or more progressive awards associated with that designated gaming device.

In one embodiment, a master host site computer is coupled to a plurality of the central servers at a variety of mutually remote gaming sites for providing a multi-site linked progressive automated gaming system. In one embodiment, a master host site computer may serve gaming devices distributed throughout a number of properties at different geographical locations including, for example, different locations within a city or different cities within a state. In one embodiment, the master host site computer is maintained for the overall operation and control of the system. In this embodiment, a master host site computer oversees all or part of the progressive gaming system and is the master for computing all or part of the progressive jackpots. All participating gaming sites report to, and receive information from, the master host site computer. Each central server computer is responsible for all data communication between the gaming device hardware and software and the master host site computer.

In one embodiment, different gaming devices in the gaming system have different progressive awards available to the player. In one such embodiment, different types of gaming devices are associated with different types of progressive awards based on the current configuration of the gaming system. In one embodiment, zero, one or more progressive awards may be associated with each of the gaming devices in the gaming system while zero, one or more different progressive awards may be associated with a plurality of, but not all of the gaming devices in the gaming system.

In one embodiment, one or more of the progressive awards are each funded, at least in part, via a side bet or side wager. In one such embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount on any payline (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner. In one such embodiment, one or more progressive awards are funded, at least partially, via an amount provided by one or more marketing and/or advertising departments, such as a casino's marketing department.

In one alternative embodiment, a minimum wager level is required for a gaming machine to qualify to be selected to obtain one of the progressive awards. In one embodiment, this minimum wager level is the maximum wager level for the primary game in the gaming machine. In another embodiment, this minimum wager level is placing a wager on all available paylines in a slot primary game or alternatively placing a wager on all available poker hands in a multi-hand poker primary game. In another embodiment, no minimum wager level is required for a gaming machine to qualify to be selected to obtain one of the progressive awards.

In one embodiment, the central server maintains at least one and preferably a plurality of values or amounts in one or more supplemental funds or pools for one or more progressive awards. As described in detail below, upon an occurrence of a progressive award increase event, the central server utilizes a value or amount from the supplemental fund or pool to periodically add or inject value to the progressive award if the progressive award is not incrementing or growing at a designated rate.

In one embodiment, the central controller maintains one supplemental fund for a plurality of progressive awards associated with the gaming system. For example, for each of the progressive awards of an MLP configuration, the central controller maintains a supplemental fund. In another embodiment, the central controller maintains one supplemental fund for each of the progressive awards associated with the gaming system. In these embodiments, the supplemental fund may include one or more secondary funds or sub-funds for each progressive award associated with that supplemental fund. In another embodiment, the central controller maintains one supplemental fund for each progressive award associated with the gaming system.

In one embodiment, at least one supplemental fund or pool is funded, at least partially, via an amount provided by one or more marketing and/or advertising departments, such as a casino's marketing department. In another embodiment, at least one supplemental fund or pool is funded, at least in part, based on an amount provided by a gaming establishment. In another embodiment, at least one supplemental fund or pool is funded, at least in part, based on the wagers placed on the primary games of the gaming machines in the gaming system. It should be appreciated that the supplemental fund or pool may be funded via any suitable manner.

In one embodiment, the amount or value initially associated with a supplemental fund is a predetermined amount or value. In another embodiment, the amount or value initially associated with a supplemental fund is determined by a gaming system operator. In different embodiments, the amount or value initially associated with a supplemental fund is randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment wherein different progressive awards are associated with different supplemental funds, the amount or value initially in a plurality of or each supplemental fund is the same or substantially the same. In another embodiment wherein different progressive awards are associated with different supplemental funds, the amount or value initially in a plurality of or each supplemental fund is different or substantially different.

In one embodiment, an amount or value is periodically added to the supplemental fund. In this embodiment, at one or more designated intervals of time and/or after the occurrence of one or more designated events, such as the value associated with the supplemental fund falling below a threshold value, an amount or value is added to the supplemental fund. In different embodiments, the determination of whether to add an amount or value to the supplemental fund is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria. In different embodiments, the amount or value to add to the supplemental fund is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

Figure 3A:
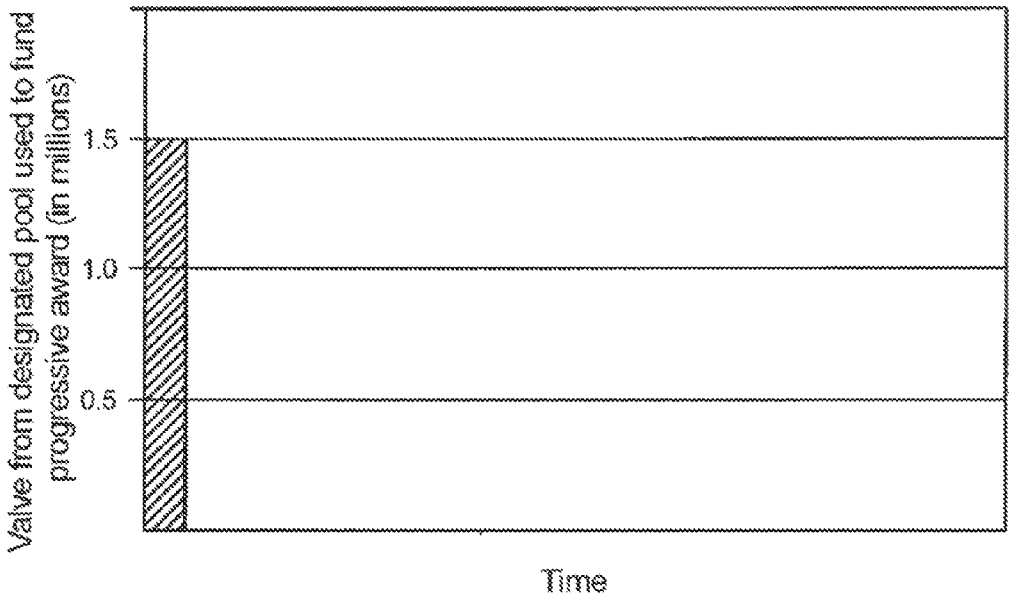
FIG. 3A (Prior Art)
FIG. 3A is a chart of one known progressive award gaming system wherein the entire value of a designated pool is used to fund a progressive award as a reset value.
Figure 3B:
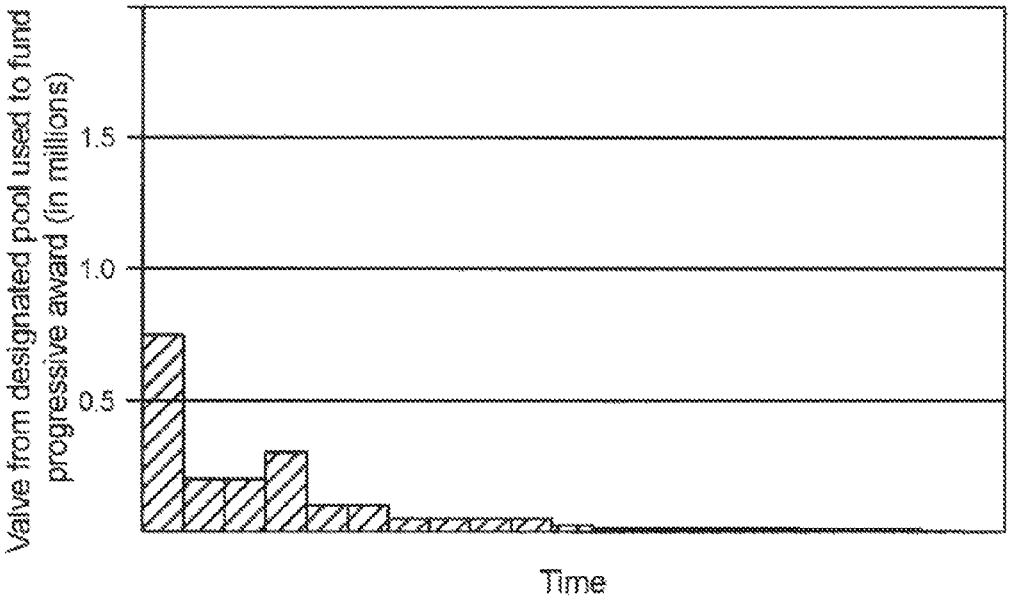
FIG. 3B is a chart of one embodiment of the gaming system disclosed herein illustrating different portions of a designated pool used to fund a progressive award at different times.

In another embodiment, the maintained supplemental fund or pool is part of a central server maintained designated fund or pool for one or more progressive awards. In this embodiment, the designated fund or pool includes a reset value or initial value for the progressive award and the supplemental fund or pool for the progressive award. This configuration provides that the central server utilizes a first portion of the designated pool associated with the progressive award (i.e., the reset value or initial value) to fund the progressive award upon the initial implementation of the progressive award (or after a progressive award is provided to a player) and further utilizes a second portion of the designated pool associated with the progressive award (i.e., the supplemental fund or pool) to periodically add or inject value into the currently incrementing progressive award. That is, rather than known progressive award gaming systems which provide the entire portion of a designated pool associated with the progressive award as the progressive award reset value (as seen as the $1,500,000 progressive award reset value in FIG. 3A), the gaming system disclosed herein provides different portions of the designated pool associated with the progressive award at different times upon different occurrences of progressive award increase events (as seen as the $750,000 progressive award reset value and the plurality of progressive award injections totaling $750,000 in FIG. 3B).

In one embodiment, the central controller maintains one designated fund for a plurality of progressive awards associated with the gaming system. For example, for each of the progressive awards of an MLP configuration, the central controller maintains a designated fund. In another embodiment, the central controller maintains one designated fund for each of the progressive awards associated with the gaming system. In these embodiments, the designated fund may include one or more secondary designated funds or sub-designated funds for each progressive award associated with that designated fund. In another embodiment, the central controller maintains one designated fund for each progressive award associated with the gaming system.

In one embodiment, at least one designated fund or pool is funded, at least partially, via an amount provided by one or more marketing and/or advertising departments, such as a casino's marketing department. In another embodiment, at least one designated fund or pool is funded, at least in part, based on an amount provided by a gaming establishment. In another embodiment, at least one designated fund or pool is funded, at least in part, based on the wagers placed on the primary games of the gaming machines in the gaming system. It should be appreciated that the designated fund or pool may be funded via any suitable manner.

In one embodiment, the amount or value initially associated with a designated fund is a predetermined amount or value. In another embodiment, the amount or value initially associated with a designated fund is determined by a gaming system operator. In different embodiments, the amount or value initially associated with a designated fund is randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, at least one progressive award is associated with a guaranteed growth rate independent of any supplemental fund or pool. In this embodiment, if a progressive award increase event occurs (as described below), the gaming system contributes to the progressive award based on the guaranteed growth rate.

Figure 4:
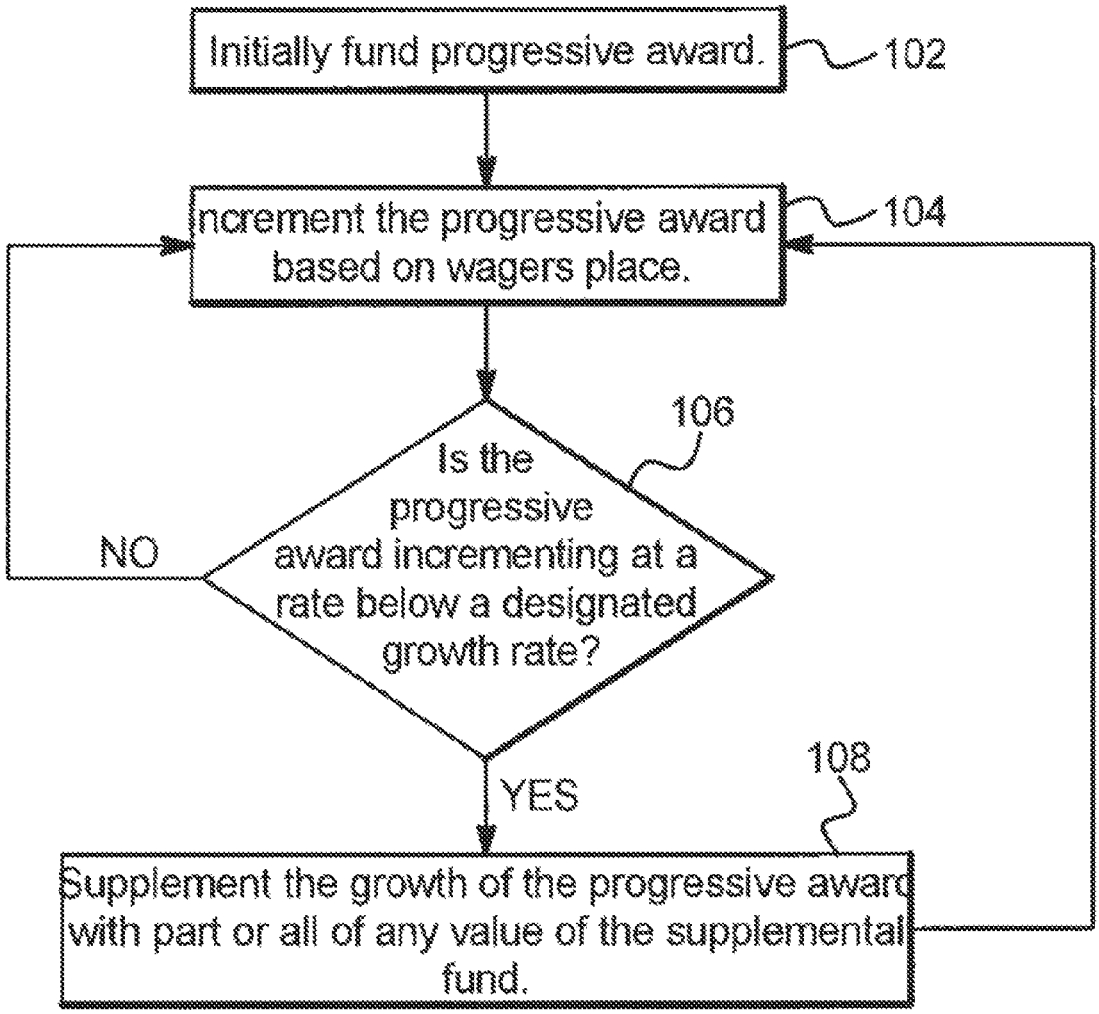
FIG. 4 is a flowchart of one embodiment of the gaming system disclosed herein illustrating a value from a supplemental fund utilized to increment a progressive award.

In one embodiment, upon the initial establishment of a progressive award in the gaming system, the central server funds the progressive award as indicated in block 102 of FIG. 4. In one embodiment, the establishment of the progressive fund is after the progressive award is provided to a player and must be reset to a base or reset value. In the embodiment wherein the central server maintains a designated fund for one or more progressive awards, the central server utilizes a first portion of the designated pool associated with the progressive award to fund the progressive award. In these embodiments, at least a fraction of the progressive award is funded by the casino by using a starting value higher than zero. In another embodiment, the starting value of the progressive award is zero.

As described above and as seen in block 104 of FIG. 4, the progressive award proceeds to grow or increment based on wagers placed at the gaming devices associated with the progressive award. That is, the progressive award accumulates based on a small percentage (such as 0.1%) of coin-in or wagered amounts in a conventional manner. In another embodiment, the percentages of wagered amounts that go to a progressive award for different wager amounts are different. For example, a wager of one to twenty-five credits may increment a progressive award 0.1% of the wager, a wager of twenty-six to fifty credits may increment a progressive award 0.08% of the wager and a wager of fifty-one to seventy-five credits may increment a progressive award 0.07% of the wager.

In one embodiment, the percentage of wagers placed that goes to each progressive award is equal (such as 0.1% to each of four progressive awards). In another embodiment, the percentage of wagers placed that goes to a plurality of or each of the progressive awards is different. In another embodiment, two or more of the progressive awards may be funded at different temporal rates. In this embodiment, the different progressive awards are incremented or funded in different increments of time wherein until the progressive award hits, a set amount is added to the progressive award at each determined time increment. In another embodiment, two or more of the progressive awards may each be incremented or funded based on different incrementing factors or incrementors. In this embodiment, a first of the progressive awards may increment each time a first incrementing factor occurs and a second of the progressive awards may increment each time a second incrementing factor occurs, wherein the first incrementing factor and the second incrementing factor are different.

In one embodiment, the central server monitors a progressive award and the incremental or growth rate of the progressive award. In one such embodiment, at preset intervals based on a suitable sampling rate, the central server determines the increment or growth rate of the progressive award. In different embodiments, the sampling rate can be based on any suitable criteria, such as amounts wagered, time elapsed or one or more other factors. In this embodiment, as indicated in diamond 106 of FIG. 4, the central server determines if the progressive award is incrementing at a rate below a designated growth rate.

In one embodiment, the central server constantly or continuously monitors the progressive award and the incremental rate of the progressive award at preset intervals to determine if a progressive award increase event occurs. In another embodiment, during designated periods of time, the central server monitors the progressive award and the incremental rate of the progressive award at preset intervals to determine if a progressive award increase event occurs. In this embodiment, depending on the current time, the central server may or may not monitor the progressive award and the increment rate of the progressive award to determine if a progressive award increase event occurs. For example, the central server will monitor a progressive award and the incremental rate of the progressive award during certain historically busy times of gaming activity and not monitor the progressive award and the incremental rate of the progressive award during other certain historically slow times of gaming activity. In this example, the central server is enabled to potentially cause one or more progressive award increase events to occur during certain time periods and is unable to cause one or more progressive award increase events to occur during certain other time periods.

In another embodiment, after a progressive award grows to or otherwise exceeds a designated amount or value, the central server stops monitoring the progressive award and the incremental rate of the progressive award at preset intervals to determine if a progressive award increase event occurs. For example, if a progressive award begins incrementing from $100,000, the central server will monitor the progressive award and the incremental rate of the progressive award until the progressive award reaches $200,000 and then the central server will discontinue or otherwise stop monitoring the progressive award and the incremental rate of the progressive award. In this example, the central server is enabled to potentially cause one or more progressive award increase events to occur when the progressive award is associated with a current value in a first value range and is unable to cause one or more progressive award increase events to occur when the progressive award is associated with a current value in a second value range.

In one embodiment, if the central server determines that the progressive award is incrementing at a rate at or above the designated growth rate, as described above, the central server continues to increment the progressive award based only on wagers placed at the gaming devices associated with the progressive award.

If the central server determines that the progressive award is incrementing at a rate below the designated growth rate (i.e., a progressive award increase event has occurred), the central server supplements the growth of the progressive award with part or all of any value of the supplemental fund or pool as indicated in block 108 of FIG. 4. That is, the central server enables a gaming system operator to specify a target or designated progressive award growth or incremental rate. If player volume is too low to support this target progressive award growth rate, the central server adds or injects value into the progressive award from the supplemental fund or pool to make up for this shortfall in the progressive award growth rate. In this embodiment, after adding at least part of any value of the supplemental fund to the progressive award, the central server continues to increment the progressive award based on wagers placed at the gaming devices associated with the progressive award as described above.

In another embodiment, the gaming system disclosed herein is implemented utilizing a stand-alone gaming device, wherein one or more progressive awards are maintained by and otherwise dedicated to the stand-alone gaming device. As described herein in relation to a central server, in this embodiment the stand-alone gaming device processor increments the progressive award based on wagers placed at the gaming device and determines if a progressive award increase event occurs, such as the maintained progressive award incrementing at a rate below a designated growth rate. In this embodiment, if the progressive award increase event occurs, the gaming device processor supplements the growth of the dedicated progressive award with part or all of any value of a supplemental fund maintained by the stand-alone gaming device.

In another embodiment, the gaming system disclosed herein is implemented over a data network, such as an internet, wherein one or more progressive awards are associated with one or more dedicated gaming sites. In one such embodiment, the central server (i.e., an internet/intranet server) increments the progressive award based on wagers placed on designated online games and determines if a progressive award increase event occurs, such as the maintained progressive award incrementing at a rate below a designated growth rate. In this embodiment, if the progressive award increase event occurs, the central server supplements the growth of the dedicated progressive award with part or all of any value of a supplemental fund associated with the dedicated gaming site.

In one embodiment, the amount or value from the supplemental fund or pool that is added to the progressive award is a determined amount or value such that the total progressive award growth rate is equal or substantially equal to the designated growth rate. In this embodiment, based on the wager based incremental rate for a period of time and the designated growth rate for the period of time, the central server determines an amount or value to add to the progressive award such that the total progressive award growth rate for the designated period of time is equal or substantially equal to the designated growth rate.

In another embodiment, the amount or value from the supplemental fund or pool that is added to the progressive award is a determined amount or value such that the total progressive award growth rate is equal or substantially equal to a base or minimum growth rate. In one such embodiment, the base or minimum growth rate is lower than the designated growth rate and greater than the actual, sampled growth rate. In this embodiment, based on the wager based incremental rate for a period of time and the base or minimum growth rate for the period of time, the central server determines an amount or value to add to the progressive award such that the total progressive award growth rate for the designated period of time is equal or substantially equal to the base growth rate. For example, if a designated incremental growth rate of a $1,000,000 progressive award is, on average, $10.00 per minute, the base incremental growth rate for the progressive award is, on average, $6.00 per minute and the progressive award is currently incrementing at, on average, $3.00 per minute for the sampled period of time, the central server utilizes the supplemental fund or pool to add an amount or value to the progressive award such that the total incremental growth rate for the progressive award is equal or substantially equal to the base incremental growth rate of $6.00 per minute.

In one embodiment, if the central server determines that the actual progressive growth rate is below the designated progressive growth rate and a progressive award increase event will occur, the central server adds a predetermined amount or value to the progressive award. In different embodiments, if the central server determines that the actual progressive growth rate is below the designated progressive growth rate and a progressive award increase event will occur, the amount or value added to the progressive award is randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, if the central server determines that the actual progressive growth rate is below the designated progressive growth rate and a progressive award increase event will occur, the central server adds value to the progressive award until the total growth rate for the progressive award is equal to or substantially equal to the designated growth rate. For example, as seen in FIG. 5, for a first sampling period for a recently reset progressive award of $1000.00, if the wager based incremental rate is $0.30 per minute (due to the low number of wagers currently placed on the gaming devices associated with the recently reset progressive award), then to raise the incremental rate to a set designated incremental growth rate of $1.00 per minute, the central server utilizes the supplemental fund to add $0.70 per minute to the progressive award. In this example, the total incremental rate for the progressive award (i.e., the wager based rate and the supplemental incremental rate) is $1.00 per minute and thus the central control ensures that the progressive award continually increments or grows at a designated rate or pace.

In another embodiment, if the central server determines that the progressive growth rate is below the designated progressive growth rate and a progressive award increase event will occur, the central server adds value to the progressive award until the total growth rate for the progressive award is equal to or substantially equal to the designated growth rate for a designated period of time.

In another embodiment, if the central server determines that the actual progressive growth rate is below the designated progressive growth rate and a progressive award increase event will occur, the central server adds value to the progressive award until the progressive award increments to a designated value. In one such embodiment, the designated value is determined based on the value of the progressive award when the central server determines that the actual progressive growth rate was below the designated progressive growth rate. In different embodiments, the designated value is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In another embodiment, if the central server determines that the actual progressive growth rate is below the designated progressive growth rate during a designated time period and a progressive award increase event will occur, the central server adds value to the progressive award. In one such embodiment, the designated time period which a progressive award increase event can occur is based on historical data for the growth of the progressive award and/or historical data relating to periods of gaming activity. In different embodiments, the designated time period which a progressive award increase event can occur is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on the amount of coin-in accumulated in one or more pools, or determined based on any other suitable method or criteria.

In one embodiment, a plurality of different progressive awards in the gaming system are each associated with the same designated growth or incremental rate. In another embodiment, each of the progressive awards in the gaming system are associated with the same designated growth or incremental rate. In another embodiment, a plurality of different progressive awards in the gaming system are each associated with a different designated growth or incremental rate. In another embodiment, each of the progressive awards in the gaming system are associated with a different designated growth or incremental rate. In different embodiments, the designated growth rate for a progressive award is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on the amount of coin-in accumulated in one or more pools, determined based on a historical analysis of progressive award values, determined based on a volume of game play at one or more designated gaming devices in the gaming system, determined based on volume of game play at certain non-progressive gaming devices in a gaming establishment, or determined based on any other suitable method or criteria.

In another embodiment, a progressive award is associated with different designated growth or incremental rates based on different periods of time. In this embodiment, the central server enables a gaming system operator to specify different progressive award growth or incremental rates for different time periods. In one such embodiment, the designated growth rate for the progressive award is higher during peak periods of gaming and slower during off-peak periods of gaming such that the progressive award matches or mimics the expected growth rate of a progressive award associated with a plurality of actively played gaming devices that increments faster during peak periods of gaming and slower during off-peak periods of gaming.

Figure 6:
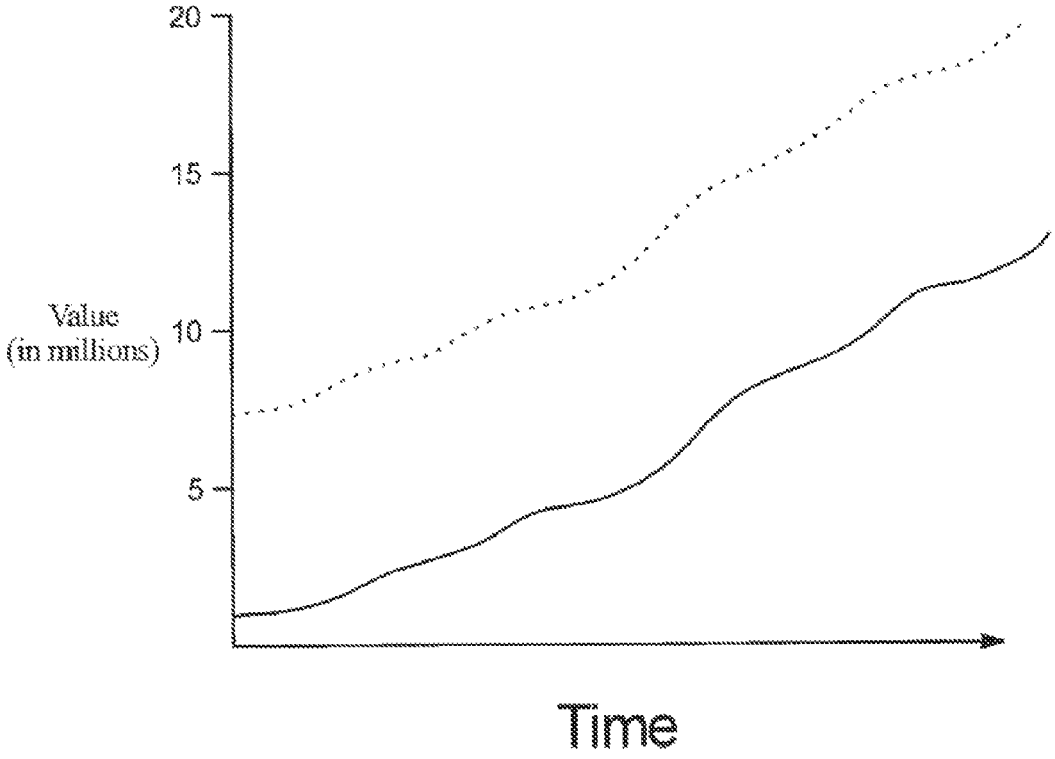
FIG. 6 is a chart of one embodiment of the gaming system disclosed herein illustrating a first progressive award emulating the progressive growth rate of a second progressive award.

In one such embodiment, the gaming system enables an operator to pick which of a plurality of progressive award growth shape curves to emulate. In different embodiments, the gaming system enables an operator to pick from a fixed progressive award growth shape curve, a theoretical progressive award growth shape curve, a concurrently incrementing progressive award growth shape curve or any other suitable type of progressive award growth shape curve. For example, as seen in FIG. 6, if the gaming system operator selects for the progressive award to emulate the growth of a concurrently incrementing MEGABUCKS® progressive award, then as the MEGABUCKS® progressive award increments or grows (as illustrated as the dotted line in FIG. 6), the central server will cause the current progressive award (illustrated at the solid line in FIG. 6) to increment or grow accordingly. That is, if the central server determines that the progressive award growth rate is below the current growth rate for the MEGABUCKS® progressive award (or a determined portion of the current growth rate for the MEGABUCKS® progressive award), the central server will cause a progressive award increase event to occur and the progressive award will increase based on a value provided from the supplemental fund. MEGABUCKS is a trademark of IGT, the assignee of this patent application.

In operation of another embodiment of the gaming system disclosed herein, the central server adds a designated value or amount to the progressive award to provide that the growth rate of the progressive award remains within a designated range over a period of time. This amount or value added to the progressive award is from the supplemental pool or fund and is in addition to any amounts added to the progressive award which arise from any wagers placed on any primary games at the gaming devices in the gaming system. In different embodiments, the amount or value added to the progressive award (to supplemental a lack of wagers placed at the gaming devices in the gaming system) is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In another embodiment, the central server determines if the progressive award is at least equal to a threshold value or amount. In this embodiment, a progressive award is associated with one or more threshold values or amounts for different periods of time (relative to the resetting of the progressive award), wherein if the central server determines that the progressive award is less than the appropriate threshold value, a progressive award increase event occurs. That is, rather than determining if the progressive award growth rate is at least equal to a designated progressive award growth rate, the central server monitors the value of the progressive award relative to a threshold value for the progressive award and determines if a progressive award increase event occurs based on this comparison.

It should be appreciated that the progressive award increase event may be any suitable event or non-occurrence of an event which may be tracked by the gaming system. In different embodiments, an occurrence of a progressive award increase event may include, but not be limited to, a determination that the progressive award is incrementing at a rate below a designated growth rate, a determination that no contributions have been made to the progressive award during a given period of time, an elapsed period of time, a determination based on a frequency of an event over an elapsed period of time, a determination based on a plurality of events occurring over an elapsed period of time, a randomly determined event, a predetermined event, a determination based on a generated symbol or symbol combination, a determination based on the status of one or more players (such as determined through a player tracking system), a determination based on a gaming system operator and any combination thereof.

In one embodiment of the gaming system disclosed herein, in addition to periodically adding non-wager based amounts to the progressive award, the gaming system determines whether to provide one or more progressive awards to one or more players at the gaming devices of the gaming system. If the gaming system determines to provide at least one progressive award to at least one player (i.e., a progressive award triggering event has occurred), the value or amount currently associated with the progressive award is provided to the player, the progressive award is reset to a reset or base value and the described above process is repeated for another progressive award.

In one embodiment, if a progressive award triggering event occurs and the progressive award is provided to one or more players while the amount or value in any supplemental fund or pool is greater than zero (i.e., before the supplemental fund is fully spent), the remaining amount in the supplemental fund is provided to the player. In one such embodiment, the remaining amount in any supplemental fund is provided to the player via one or more bonus games or bonus sequences. In another embodiment, if a progressive award triggering event occurs and the progressive award is provided to one or more players while the amount or value in any supplemental fund or pool is greater than zero, the remaining amount in the supplemental fund is utilized as part of the next supplemental fund for the next progressive award. In another embodiment, if a progressive award triggering event occurs and the progressive award is provided to one or more players while the amount or value in any supplemental fund or pool is greater than zero, the remaining amount in the supplemental fund is returned to the entity that originally provided the amount or value for the supplemental fund.

In one embodiment, a progressive award triggering event occurs and the progressive award is provided to one or more players of the linked gaming machines based on an outcome associated with one or more plays of any primary game and/or an outcome associated with one or more plays of any secondary game of the gaming machines in the gaming system. In one such embodiment, the determination of when to provide such a progressive award is symbol driven based on the generation of one or more designated symbols or symbol combinations. That is, when the designated symbol combination is randomly generated, the progressive award associated with this symbol-driven event is provided to a player. It should be appreciated that since the determination of when to provide this progressive award is based on a probability, the amount which this progressive award is incremented to is uncapped or unlimited and thus may grow to large levels.

In one embodiment, at least one and preferably a plurality of the progressive awards maintained by the gaming system are provided to players of the linked gaming machines in an apparently random fashion as perceived by the players of these gaming machines. These progressive awards are distinguished from the awards that the gaming machines provide to the players for winning outcomes in the plays of the primary wagering games, such as slot games, card games (e.g., poker, blackjack) or any other suitable game.

In one embodiment, the gaming devices do not provide any apparent reasons to the players for obtaining such progressive awards. In this embodiment, providing the progressive awards is not triggered by an event in the primary game or based specifically on any of the plays of any primary game or on any of the plays of any secondary game of the gaming machines in the system. That is, these progressive awards are provided to the players without any explanation or alternatively with simple explanations.

In one embodiment, the gaming machines of the gaming system are operable to provide multiple progressive awards to multiple players at the multiple linked gaming machines at the same time or substantially the same time. Alternatively, the gaming machines of the gaming system are operable to provide multiple progressive awards to multiple players at the multiple linked gaming machines in an overlapping or sequential manner.

In one embodiment, the gaming system determines when to provide one or more of the progressive awards to one or more players based on when a designated amount of wagers or type of wagers are placed at one or more of the gaming devices of the gaming system. That is, these ranged progressive awards, accumulated value progressive awards or $N^{th}$ coin progressive awards are not symbol-driven, but rather are driven by an amount of wagers placed or a suitable coin-in amount. In one embodiment, each progressive award is associated with a range of values, wherein each progressive award will be provided to a player of a gaming device in the gaming system when the progressive award increments to a progressive award hit value within the range of values associated with that progressive award.

In different embodiments, the progressive award hit value at which a progressive award triggering event will occur and that ranged progressive award will be provided to a player is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria. For example, if a progressive hit value of $37.50 is selected as the predetermined progressive hit value for a first ranged progressive award, then when the first ranged progressive award increases to $37.50, a triggering event will occur and the first ranged progressive award will be provided to a player. After the first ranged progressive award is provided to a player, the first ranged progressive award is reset to a default value and starts incrementing from the default progressive award level. It should be appreciated that although the first ranged progressive award is reset to an appropriate progressive award level, none of the remaining progressive awards are reset or otherwise affected by the triggering of the first progressive award. It should be further appreciated that in this embodiment, as the gaming system determines the progressive hit value, the gaming system is configured to provide the progressive award the full amount of the supplemental fund prior to the progressive award reaching the progressive hit value.

In one embodiment, a ranged progressive award is provided to the player whose coin-in caused that ranged progressive award to increment to its predetermined progressive hit value. In different embodiments, the coin-in is determined in any suitable manner, such as by calculating which coin-in will cause the value to change to that's progressive awards predetermined progressive hit value, by monitoring the coins-in versus the progressive award value or by calculating the coin-in value in advance based on the wagers, the progressive award hit value, and the percentage of the wagers allocated to the progressive award. Additionally, in one embodiment, instead of calculating the coin-in for a predetermined progressive hit value, the gaming machine uses the range information, the hit values and the wagers placed to determine a range of coin-in values which satisfy the parameters for that ranged progressive. It should be appreciated that this gaming system chooses an appropriate coin-in hit value in any suitable manner. For example, the system randomly chooses the coin-in hit value, chooses the coin-in hit value based on a weighted parameter, chooses the coin-in hit value based upon a determined subset range, or chooses the coin-in hit value based on any other suitable manner.

In one embodiment, a plurality of the progressive awards are associated with different value ranges. In another embodiment, each of the progressive awards is associated with a different value range. In another embodiment, a plurality of the progressive awards are associated with the same value range. In one embodiment, such progressive awards are maintained by the central controller and adapted to be provided to any of the gaming machines in the gaming system. In another embodiment, such progressive awards are maintained by each individual gaming machine and adapted to be provided to a player of that individual gaming machine.

In another alternative embodiment, a triggering event for one or more of the progressive awards occurs based on a predefined variable reaching a defined parameter threshold. For example, a progressive award triggering event occurs when the $500^{th}$ different player has played a gaming machine associated with one of the progressive awards (ascertained from a player tracking system). In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In another alternative embodiment, a triggering event for one or more of the progressive awards occurs based on time. In this embodiment, a time is set for when a progressive triggering event will occur. In one embodiment, such a set time is based on historic data. For example, if previous progressives have reached $5 million after approximately sixty-seven days, a progressive award may be set to trigger sixty-seven days from when the progressive award is reset. In one embodiment, a suitable algorithm is implemented to determine the player who wagered at or closest to this time with tie-breaking based on any number of factors (e.g., player tracking history, amount of or recent wagers placed). In this embodiment, a triggering event occurs and a progressive award is provided to the player who the algorithm determined wagered closest to when the progressive award is triggered. In another embodiment, one of the players who wagered during a designated time period is randomly selected and the progressive award is provided to the selected player.

In another embodiment, a triggering event for one or more of the progressive awards occurs based upon gaming system operator defined player eligibility parameters stored on a player tracking system (such as via a player tracking card or other suitable manner). For example, a gaming system operator may choose to only enable players of the highest player tracking status to be eligible for a progressive award. In this embodiment, the parameters for eligibility are defined by the gaming system operator based on any suitable criterion. In one embodiment, the central controller/gaming device processor recognizes the player's identification (via the player tracking system) when the player inserts their player tracking card in the gaming machine. The central server/gaming device processor determines the player tracking level of the player and if the current player tracking level defined by the gaming system operator is eligible for the progressive award. In one embodiment, the gaming system operator defines minimum bet levels required for the progressive award based on the player's card level. In this embodiment, different bet amounts are required to be eligible to receive different progressive award levels. In another embodiment, as described above, different side bets or side-wager amounts are required to be eligible to receive different progressive award levels. Once the central controller/gaming device processor determines which players are eligible, any suitable method for awarding the progressive award may be employed.

Another embodiment for determining the winner of one or more of the progressive awards includes a system determination, wherein the progressive award is provided due to a random selection by the central controller. In one embodiment, the central controller tracks all active gaming machines and the wagers they placed. Each gaming machine has its own entry defining its state as either active or inactive and also defining the values of the wagers from that gaming machine. In one embodiment, active status means that the gaming machine is being actively played by a player and enrolled/inactive status means that the gaming machine is not being actively played by a player. The active status requirements can be based on any suitable number of satisfied criteria or defined in any suitable manner by the implementer of the gaming system. For instance, a play of or wager on the primary game of the gaming machine within a predetermined period of time may be part of the determination of whether that gaming machine is in the active status. Other factors such as: (a) the amount of time between each play of or wager on the primary game of the gaming machine; (b) the amount being wagered on the primary game(s); and (c) the number of plays within a period of time, may also or alternatively be part of the determination of whether a gaming machine is in the active status. On the other hand, inactive status means that the gaming machine is one of the gaming machines in the gaming system, but is not in the active status (i.e., not being actively played by a player according to one or more of the predetermined criteria).

In one such embodiment, based on the gaming machine's state, the central controller determines which of these gaming machines receives any of the progressive awards. In one embodiment, the gaming machine which has been classified as active the longest since the last triggering event is provided at least one progressive award. In another embodiment, the determination of the winner of one or more of the progressive awards is based on the relative proportion of gaming/wagering activity at each gaming device in the gaming system. In this embodiment, the player who consistently places a higher wager is more likely to receive one of the progressive awards than a player who consistently places a minimum wager.

In another embodiment, a progressive award is provided by determining if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, that particular gaming machine is provided all or part of one of the progressive awards.

In one embodiment, the central controller and an individual gaming machine work in conjunction with each other to determine when one or more of the progressive award wins are triggered, for example through an individual gaming machine meeting a predetermined requirement or criteria established by the central controller. In another embodiment, an individual gaming machine may determine when one or more progressive award wins are triggered. In another embodiment, an individual gaming machine may determine when at least one progressive award win is triggered and the central controller determines when at least one progressive award win is triggered. It should be appreciated that any suitable determination of how and when one or more progressive awards are provided to one or more players may be implemented in accordance with the gaming system disclosed herein.

Information Provided to Player

In one embodiment, when adding a value or amount to the progressive award, the gaming system displays suitable information about the value added to the progressive award through one or more displays on the gaming machines or additional information displays positioned near the gaming machines (such as above a bank of system gaming machines) or remote from the gaming machines (such as at a different location in a casino). These displays indicate to one or more players (or potential players) that the progressive award has increased independent of any wager-based growth. For example, as seen in FIG. 7A, if the gaming system determines to provide a value from the supplemental pool to the progressive award, the gaming device displays appropriate messages such as "VALUE OF PROGRESSIVE AWARD: $1,005,651.19", "THIS PROGRESSIVE AWARD NEEDS A PICK-ME-UP" and "LET'S GIVE THIS PROGRESSIVE AWARD A BOOST" to the player visually, or through suitable audio or audiovisual displays. As seen in FIG. 7B, after determining to provide the progressive award $1000 from the supplemental pool, the gaming device displays appropriate messages such as "CASINO X HAS ADDED $1000 TO THE PROGRESSIVE AWARD", "NEW VALUE OF PROGRESSIVE AWARD: $1,006,651.19" and "GOOD LUCK PLAYERS" to the player visually, or through suitable audio or audiovisual displays.

As indicated above, the progressive awards may be provided to the players of the gaming machines with or without explanation or information provided to the player, or alternatively information can be displayed to the player. In one embodiment, suitable information about the progressive awards can be provided to the players through one or more displays on the gaming machines or additional information displays positioned near the gaming machines, such as above a bank of system gaming machines. In one embodiment, a metering and/or information display device may be used to display information regarding the progressive awards. This information can be used to entertain the player or inform the player that a progressive award triggering event has occurred or will occur. Examples of such information are:

(1) that a progressive award triggering event has occurred;

(2) that a progressive award triggering event will shortly occur (i.e., foreshadowing the providing of a progressive award);

(3) that one or more progressive awards have been provided to one or more players of the system gaming machines;

(4) which gaming machines have won the progressive awards;

(5) the amount of the progressive awards won;

(6) the highest progressive award won;

(7) the lowest progressive award won;

(8) the average progressive award won;

(9) number of games played/total time since the last progressive award was won;

(10) the number of progressive awards won in a designated time period;

(11) the upper limit or range which one or more progressive awards can increment to; and

(12) an average amount of time between each progressive award being won. It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one gaming device including:

(i) at least one gaming device display device, and (ii) at least one gaming device input device;

at least one controller configured to communicate with said at least one gaming device, at least one controller display device, and at least one controller input device, said at least one controller programmed to:

(a) receive an input from an operator of a selection of one of a plurality of different progressive award increment configurations, wherein each progressive award increment configuration is associated with at least one progressive award increment rate at least one point in time;

(b) maintain a progressive award associated with the selected progressive award increment configuration;

(c) cause the maintained progressive award to be displayed;

(d) increment said displayed progressive award based on at least one wager placed on at least one play of at least one primary game at said at least one gaming device;

(e) if the progressive award increment configuration of the maintained progressive award is different from the selected progressive award increment configuration at a first point in time, modify the maintained progressive award; and (f) if a progressive award triggering event occurs, cause the maintained progressive award to be provided.

2. The gaming system of claim 1, wherein if the progressive award increment configuration of the maintained progressive award is associated with an increment rate at the first point in time which is less than an increment rate at the first point in time associated with the selected progressive award increment configuration, the at least one controller is programmed to, independent of any wagers placed on any play of any primary game at any of said at least one gaming device, increment said maintained progressive award by a supplemental amount.

3. The gaming system of claim 2, wherein said supplemental amount is from a supplemental fund associated with said at least one maintained progressive award.

4. The gaming system of claim 1, wherein at least one of the progressive award increment configurations is associated with a plurality of different progressive award increment rates at a plurality of different points in time.

5. The gaming system of claim 1, wherein each of the progressive award increment configurations is associated with a plurality of different progressive award increment rates at a plurality of different points in time.

6. The gaming system of claim 1, wherein at least one of the progressive award increment configurations is selected from a group consisting of: a static progressive award increment curve, a theoretical progressive award increment curve and a concurrently incrementing progressive award increment curve.

7. The gaming system of claim 1, which includes a plurality of gaming devices, each gaming device including at least one gaming device display device and at least one gaming device input device.

8. The gaming system of claim 7, wherein the at least one controller is programmed to increment said displayed progressive award based on a plurality of wagers placed on a plurality of plays of a plurality of primary games at said gaming devices.

9. A method of operating a gaming system, said method comprising:

(a) receiving an input from an operator of a selection of one of a plurality of different progressive award increment configurations, wherein each progressive award increment configuration is associated with at least one progressive award increment rate at least one point in time;

(b) causing at least one controller to execute a plurality of instructions to maintain a progressive award associated with the selected progressive award increment configuration;

(c) causing at least one display device to display the maintained progressive award;

(d) causing the at least one controller to execute the plurality of instructions to increment said displayed progressive award based on at least one wager placed on at least one play of at least one primary game at least one gaming device;

(e) if the progressive award increment configuration of the maintained progressive award is different from the selected progressive award increment configuration at a first point in time, causing the at least one controller to execute the plurality of instructions to modify the maintained progressive award; and (f) if a progressive award triggering event occurs, causing the maintained progressive award to be provided.

10. The method of claim 9, which includes, if the progressive award increment configuration of the maintained progressive award is associated with an increment rate at the first point in time which is less than an increment rate at the first point in time associated with the selected progressive award increment configuration, independent of any wagers placed on any play of any primary game at any of said at least one gaming device, causing the at least one controller to execute the plurality of instructions to increment said maintained progressive award by a supplemental amount.

11. The method of claim 10, wherein said supplemental amount is from a supplemental fund associated with said at least one maintained progressive award.

12. The method of claim 9, wherein at least one of the progressive award increment configurations is associated with a plurality of different progressive award increment rates at a plurality of different points in time.

13. The method of claim 9, wherein each of the progressive award increment configurations is associated with a plurality of different progressive award increment rates at a plurality of different points in time.

14. The method of claim 9, wherein at least one of the progressive award increment configurations is selected from a group consisting of: a static progressive award increment curve, a theoretical progressive award increment curve and a concurrently incrementing progressive award increment curve.

15. The method of claim 9, which includes causing the at least one controller to execute the plurality of instructions to increment said displayed progressive award based on a plurality of wagers placed on a plurality of plays of a plurality of primary games at a plurality of gaming devices.

16. The method of claim 9, which is executed through a data network.

17. The method of claim 16, wherein the data network is an internet.

18. A non-transitory computer readable medium including a plurality of instructions, which when executed by at least one controller, cause the at least one controller to:

(a) receive an input from an operator of a selection of one of a plurality of different progressive award increment configurations, wherein each progressive award increment configuration is associated with at least one progressive award increment rate at least one point in time;

(b) maintain a progressive award associated with the selected progressive award increment configuration;

(c) cause at least one display device to display the maintained progressive award;

(d) increment said displayed progressive award based on at least one wager placed on at least one play of at least one primary game at least one gaming device;

(e) if the progressive award increment configuration of the maintained progressive award is different from the selected progressive award increment configuration at a first point in time, modify the maintained progressive award; and (f) if a progressive award triggering event occurs, cause the maintained progressive award to be provided.

19. The non-transitory computer readable medium of claim 18, wherein if the progressive award increment configuration of the maintained progressive award is associated with an increment rate at the first point in time which is less than an increment rate at the first point in time associated with the selected progressive award increment configuration, when executed by the at least one controller, the plurality of instructions cause the at least one controller to, independent of any wagers placed on any play of any primary game at any of said at least one gaming device, increment said maintained progressive award by a supplemental amount.

20. The non-transitory computer readable medium of claim 19, wherein said supplemental amount is from a supplemental fund associated with said at least one maintained progressive award.

21. The non-transitory computer readable medium of claim 18, wherein at least one of the progressive award increment configurations is associated with a plurality of different progressive award increment rates at a plurality of different points in time.

22. The non-transitory computer readable medium of claim 18, wherein each of the progressive award increment configurations is associated with a plurality of different progressive award increment rates at a plurality of different points in time.

23. The non-transitory computer readable medium of claim 18, wherein at least one of the progressive award increment configurations is selected from a group consisting of: a static progressive award increment curve, a theoretical progressive award increment curve and a concurrently incrementing progressive award increment curve.

24. The non-transitory computer readable medium of claim 18, wherein when executed by the at least one controller, the plurality of instructions cause the at least one controller to increment said displayed progressive award based on a plurality of wagers placed on a plurality of plays of a plurality of primary games at a plurality of gaming devices.

* * * * *

UNITED STATES PATENT AND TRADEMARK OFFICE

CERTIFICATE OF CORRECTION

PATENT NO. : 8,449,388 B2
APPLICATION NO. : 13/335420
DATED : May 28, 2013
INVENTOR(S) : Mark C. Nicely et al.

It is certified that error appears in the above-identified patent and that said Letters Patent is hereby corrected as shown below:

IN THE CLAIMS

In Claim 1, Column 37, Line 60, after ";" insert --and--.
In Claim 1, Column 38, Line 2, between "rate" and "at" insert --at--.
In Claim 3, Column 38, Lines 30 and 31, delete "at least one".
In Claim 6, Column 38, Line 42, replace the first instance of "a" with --the--.
In Claim 9, Column 38, Line 61, between "rate" and "at" insert --at--.
In Claim 9, Column 39, Line 4, between "game" and "at" insert --at--.
In Claim 11, Column 39, Lines 25 and 26, delete "at least one".
In Claim 14, Column 39, Line 37, replace the first instance of "a" with --the--.
In Claim 18, Column 40, Line 3, between "rate" and "at" insert --at--.
In Claim 18, Column 40, Line 10, between "game" and "at" insert --at--.
In Claim 20, Column 40, Line 31, delete "at least one".
In Claim 23, Column 40, Line 44, replace the first instance of "a" with --the--.

Signed and Sealed this
Twenty-eighth Day of January, 2014

Michelle K. Lee

Michelle K. Lee
*Deputy Director of the United States Patent and Trademark Office*